US006799001B2

(12) United States Patent
Takeuchi et al.

(10) Patent No.: US 6,799,001 B2
(45) Date of Patent: Sep. 28, 2004

(54) PROCESS CARTRIDGE DETACHABLY MOUNTABLE TO AN IMAGE FORMING APPARATUS AND IMAGE FORMING APPARATUS INCLUDING IMAGE CONTROL MEANS FOR ADJUSTING AN IMAGE ON A TRANSFERRING MATERIAL

(75) Inventors: Akihiko Takeuchi, Shizuoka (JP); Kazuhiro Funatani, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 42 days.

(21) Appl. No.: 10/050,927

(22) Filed: Jan. 22, 2002

(65) Prior Publication Data

US 2002/0098005 A1 Jul. 25, 2002

(30) Foreign Application Priority Data

Jan. 24, 2001 (JP) ..... 2001-016097

(51) Int. Cl.[7] ..... G03G 15/00
(52) U.S. Cl. ..... 399/49
(58) Field of Search ..... 399/25, 27, 29, 399/49, 111

(56) References Cited

U.S. PATENT DOCUMENTS 4,632,537 A * 12/1986 Imai ..... 399/29
4,961,088 A * 10/1990 Gilliland et al. ..... 399/25
5,272,503 A * 12/1993 LeSueur et al. ..... 399/25
5,412,455 A 5/1995 Ono et al. ..... 355/219
5,572,292 A * 11/1996 Chatani et al. ..... 399/29 X
5,950,043 A * 9/1999 Fujita et al. ..... 399/49 X
6,070,022 A * 5/2000 Kobayashi et al. ..... 399/49 X

FOREIGN PATENT DOCUMENTS

JP 7-98526 * 4/1995

OTHER PUBLICATIONS

U.S. patent application Ser. No. 09/711,509, Uchiyama et al., filed Nov. 14, 2000.

* cited by examiner

*Primary Examiner*—Fred L. Braun
(74) *Attorney, Agent, or Firm*—Fitzpatrick, Cella, Harper & Scinto

(57) ABSTRACT

A cartridge includes at least a developing device and is detachably mountable to an image forming apparatus. The image forming apparatus includes an image controller for adjusting an image on a transferring material either by directly detecting the density of a toner image formed on an image bearing body or by transferring the toner image onto a second image bearing body and detecting a density of the transferred toner image. The cartridge includes a memory storing a correction parameter, which is used to determine how a control parameter of the image controller should be changed in accordance with the degree of wear of the process cartridge.

20 Claims, 9 Drawing Sheets

PROCESS CARTRIDGE DETACHABLY MOUNTABLE TO AN IMAGE FORMING APPARATUS AND IMAGE FORMING APPARATUS INCLUDING IMAGE CONTROL MEANS FOR ADJUSTING AN IMAGE ON A TRANSFERRING MATERIAL

BACKGROUND OF THE INVENTION

1. Field of the Invention

The present invention generally relates to an image forming apparatus using an electrophotographic system, a cartridge detachably mountable to a main body of the image forming apparatus, which is to say a process cartridge, and to a developing apparatus constructed as a cartridge.

In this case, examples of the electrophotographic image forming apparatus include an electrophotographic copying machine, an electrophotographic printer (for instance, an LED printer, a laser beam printer, and the like), an electrophotographic facsimile apparatus, and the like.

Also, the cartridge detachably mountable to the main body of the electrophotographic image forming apparatus is a cartridge including at least one of an electrophotographic photosensitive body, a charging means for charging the electrophotographic photosensitive body, a developing means for supplying developer to the electrophotographic photosensitive body, and a cleaning means for cleaning the electrophotographic photosensitive body. In particular, the process cartridge integrally combines the electrophotographic photosensitive body with at least one of the charging means, the developing means, and the cleaning means into a cartridge detachably mountable to the main body of the electrophotographic photosensitive body. Alternatively, the process cartridge integrally combines at least the developing means with the electrophotographic photosensitive body into a cartridge detachably mountable to the main body of the electrophotographic image forming apparatus.

2. Related Background Art

An example of a conventional electrophotographic image forming apparatus is shown in FIG. 12. In this drawing, the image forming apparatus includes a photosensitive drum 101 as an electrophotographic photosensitive body to which an organic photosensitive body (organic photo-conductor) is applied or a photo-conductive body made of A—Si, Cds, Se, or the like on the outer peripheral surface of an aluminum cylinder. This photosensitive drum 101 is driven by an unillustrated driving means in a direction indicated by the illustrated arrow and is uniformly charged at a predetermined potential by a roller charger 102 that is a charging means.

In the upper portion of the main body of the apparatus, there are disposed a laser diode 111 that constitutes an exposing apparatus as an electrostatic latent image forming means, a polygon mirror 109 that is rotatably driven by a high speed motor 108, a lens 110, and a return mirror 107.

When an image signal is inputted into a laser driver 112, the laser driver 112 causes the laser diode 111 emit light. Then, the light having optical information corresponding to the image signal travels along an optical path 113 and irradiates the photosensitive drum 101, thereby forming an electrostatic latent image. Further, when the photosensitive drum 101 is rotated in the arrow direction, this electrostatic latent image is developed by a developing apparatus (developing means) 104, thereby obtaining a toner visible image. The toner visible image obtained by the development is transferred onto transferring paper P, which is a transferring material, by a transferring roller 103 that is a transferring means to which a predetermined bias is applied. The transferring paper P is conveyed by a convey means to a fixing apparatus 105, and the toner visible image is melted and fixed by the fixing apparatus 105. In this manner, there is obtained a permanent image.

On the other hand, residual toner on the photosensitive drum 101 is removed by a cleaning apparatus 106 such as a fur brush or a blade means.

By the way, in an image forming apparatus that uses an electrophotographic system and outputs a gradation image, there generally exists a relation between inputted image signals and outputted images, that is, there exists a gradation characteristic, as shown in FIG. 13. If this default gradation characteristic is used as it is, it is impossible to obtain a high-quality image in the usual cases. Therefore, in actual cases, before being inputted into the laser driver 112, the image signals are adjusted by referring to a look-up table (hereinafter referred to as the "LUT") formed in a RAM within a memory 121 so that the gradation characteristic becomes an appropriate relation such as a linear relation. To do so, halftone control is performed by experimentally forming toner images (hereinafter referred to as the "patch patterns") used to detect image densities on the photosensitive drum 101 from all image signals that can be dealt with, detecting densities of these toner images using an optical density sensor 122 or the like, obtaining a present gradation characteristic of the image forming apparatus from the detection results, and creating an LUT according to the obtained present gradation characteristic. This makes it possible to obtain a desired gradation characteristic with precision.

In more detail, in FIG. 12, a CPU 120 inputs signals for forming the patch patterns into the laser driver 112, and then visualized images are formed on the photosensitive drum 101. The optical density sensor 122 detects the visualized images, and an LUT is created in the RAM within the memory 121 functioning as a storage means according to the detection results.

By detecting the patch patterns formed on the photosensitive drum 101 using the optical density sensor 122 in this manner, it becomes possible to directly correct the relations between image signals and images formed on the photosensitive drum 101 using the LUT. However, images that are finally obtained the are images transferred from the photosensitive drum 101 onto the transferring paper P. Therefore, in actual cases, with consideration given to a transfer efficiency during this image transfer, correction amounts given by the LUT are determined so that there can be finally obtained correct relations between the image signals and the images on the transferring paper P.

Also, the correction performed using the LUT is a halftone correction and therefore, if the maximum value of a density of an image to be printed varies, it becomes difficult to perform correction using the LUT. In view of this problem, there is used a method with which prior to the halftone correction, a patch pattern used to detect the maximum density is additionally formed on the photosensitive drum 101 and a developing bias voltage applied to the developing apparatus 104 and a bias voltage applied to the charging means 102 for charging the photosensitive drum 101 are adjusted according to a detection result of the patch pattern. In this manner, the maximum density is corrected.

In actual cases, like the halftone correction, this maximum density correction is also performed by determining a target value for the density of the patch pattern on the photosensitive drum 101 with consideration given to the transfer efficiency during the final transfer of the toner image onto the transferring paper P.

However, if the density detection is performed by forming a patch pattern at a place other than the transferring paper P in this manner, when the transfer efficiency to the transferring paper P varies due to endurance, that is, due to an extended period of use of the apparatus, there occurs a problem that even though the toner image density on the photosensitive drum 101 is properly corrected, the final image on the transferring paper varies due to the endurance.

In particular, in the case of a full-color image forming apparatus that forms a full-color image using toner in four colors, variations of halftone densities result in variations of hues. Consequently, the stated problem becomes more serious than in a case of a monochrome image forming apparatus.

As a method of preventing this problem, there is a method with which the halftone correction and the maximum density correction described above are performed by directly transferring the aforementioned patch patterns onto transferring paper and detecting these patterns after transfer, more preferably after fixation.

In this case, however, there occurs a problem that the transferring paper P is additionally consumed each time the density correction is performed and therefore this method is not economical.

SUMMARY OF THE INVENTION

Therefore, an object of the present invention is to provide an image forming apparatus and a cartridge which can economically perform image density control with stability at all times for a long period of time.

The above-mentioned object is attained by an image forming apparatus and a cartridge according to the present invention. In short, the present invention provides an image forming apparatus, to which a cartridge including at least a developing means is detachably mountable, comprising: an image control means for adjusting an image on a transferring material by directly detecting the density of a toner image formed on an image bearing body or by transferring the toner image onto a second image bearing body and detecting the density of the transferred toner image, characterized in that a control parameter of the image control means is changed according to the degree of wear of the cartridge.

According to one aspect of the present invention, in the image forming apparatus, a correction parameter is stored and held in advance in a storage means mounted in the cartridge, the correction parameter being used to determine, according to the degree of wear of the cartridge, the degree to which the control parameter of the image control means should be changed.

According to another aspect of the present invention, in the image forming apparatus, the control parameter of the image control means is an image forming condition after image control is performed. According to another aspect of the present invention, in the image forming apparatus, the control parameter of the image control means is a target density during image control.

According to another aspect of the present invention, in the image forming apparatus, the control parameter of the image control means is a density conversion table that is used when the toner image on the image bearing body is detected during image control. According to another aspect of the invention, in the image forming apparatus, the control parameter of the image control means is a look-up table that is used during halftone control.

According to another aspect of the present invention, in the image forming apparatus, the control parameter of the image control means is a condition concerning transfer of a density detection toner image onto the second image bearing body, the transfer being performed in a case where image control is performed by forming the density detection toner image on the image bearing body using the developing means, transferring the density detection toner image onto the second image bearing body, and detecting the density of the transferred density detection toner image.

According to another aspect of the present invention, there is provided a cartridge that includes at least a developing means and is detachably mountable to a color image forming apparatus including an image control means for adjusting an image on a transferring material by directly detecting the density of a toner image formed on an image bearing body or by transferring the toner image onto a second image bearing body and detecting a density of the transferred toner image. The cartridge comprises: a storage means, in which a correction parameter is stored and held in the storage means, the correction parameter being used to determine, according to the degree of wear of the cartridge, the degree to which a control parameter of the image control means should be changed.

According to another aspect of the invention, in the above-mentioned aspects, the degree of wear of the cartridge is sequentially stored in the storage means.

According to another aspect of the invention, in the above-mentioned aspects, the cartridge is a process cartridge that further integrally includes an electrophotographic photosensitive body that is the image bearing body; and at least one of a charging means for charging the electrophotographic photosensitive body and a cleaning means for cleaning the electrophotographic photosensitive body.

With the technique of the present invention, there is realized an image forming apparatus to which a cartridge including at least a developing means is detachably mountable, the image forming apparatus comprising: an image control means for adjusting an image on a transferring material either by directly detecting the density of a toner image formed on an image bearing body or by transferring the toner image onto a second image bearing body and detecting the density of the transferred toner image, wherein a control parameter of the image control means is changed according to the degree of wear of the cartridge. With this construction, it becomes possible to economically perform image density control with stability at all times. In addition, this effect lasts for a long time. This makes it possible to obtain high-quality images at all times.

Also, there is realized a cartridge that includes at least a developing means and is detachably mountable to a color image forming apparatus including an image control means for adjusting an image on a transferring material either by directly detecting the density of a toner image formed on an image bearing body or by transferring the toner image onto a second image bearing body and detecting the density of the transferred toner image, the cartridge comprising a storage means, wherein a correction parameter is stored and held in the storage means, the correction parameter being used to determine, according to the degree of wear the cartridge, the degree to which a control parameter of the image control means should be changed. This construction contributes to making it possible to economically perform image density control with stability at all times. In addition, this effect lasts for a long time. This construction also contributes to making it possible to obtain high-quality images at all times.

These and other objects and advantages of the invention may be readily ascertained by referring to the following description and accompanying drawings.

DETAILED DESCRIPTION OF THE PREFERRED EMBODIMENTS

An image forming apparatus and a cartridge according to the present invention will be described in more detail below with reference to the drawings.

First Embodiment

Figure 1:
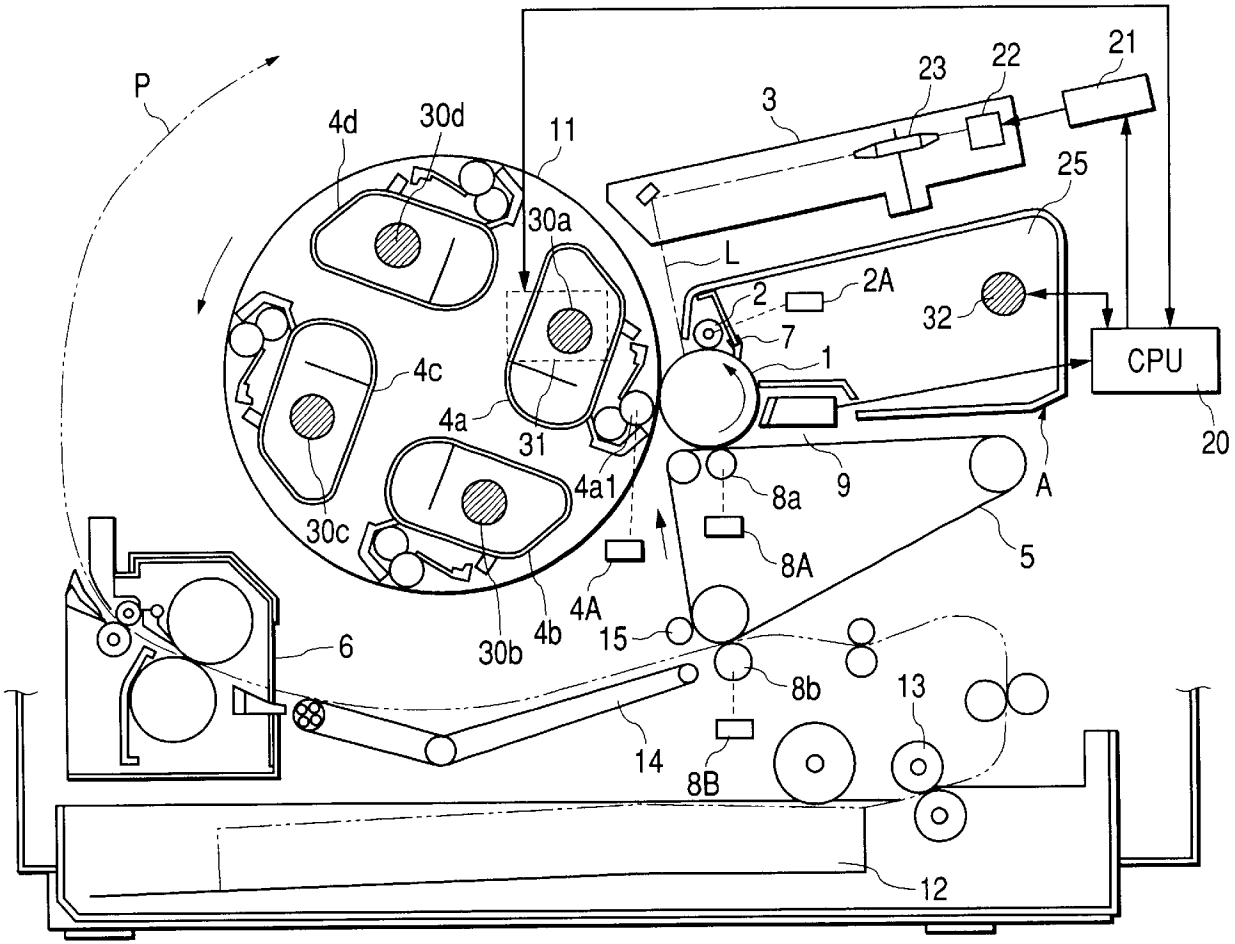
FIG. 1 is a construction diagram showing an embodiment of a color image forming apparatus according to the present invention.

The first embodiment of the present invention will be described. FIG. 1 schematically shows a color printer that is an electrophotographic image forming apparatus of this embodiment.

Figure 2:
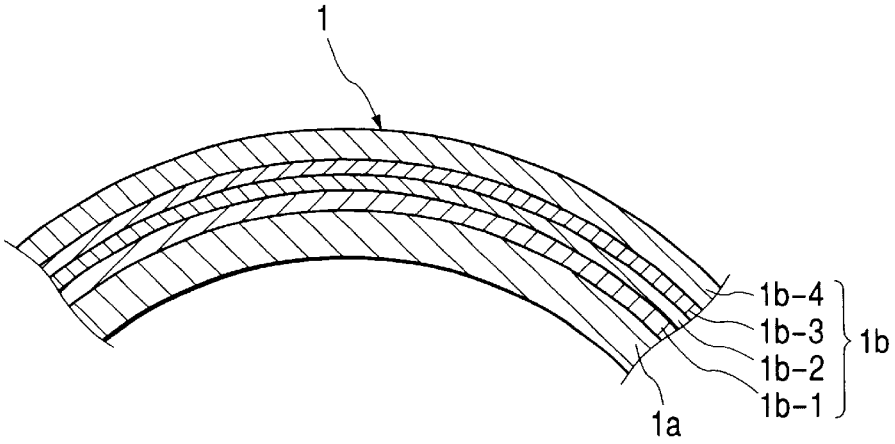
FIG. 2 is a cross sectional view showing a layer construction of a photosensitive drum of the color image forming apparatus shown in FIG. 1.

The construction and operation of this color printer will be described below with reference to the drawings. A photosensitive drum 1 that is an electrophotographic photosensitive body functioning as an image bearing body is driven by an unillustrated driving means in a direction indicated by the illustrated arrow and is uniformly charged by a primary charger 2 that is a charging means connected to a charge bias power supply 2A. As shown in FIG. 2, the photosensitive drum 1 is obtained by forming and applying a photosensitive layer 1*b*, which is formed of ordinary organic body layers (OPC: organic photo-conductor), on the outer peripheral surface of a grounded drum base body 1*a* made of a conductive material such as aluminum. Further, the photosensitive layer 1*b* includes four layers. That is, the photosensitive layer 1*b* includes an undercoating layer (UCL) 1*b*-1, an charge injection preventing layer (CPL) 1*b*-2, a charge generating layer (CGL) 1*b*-3, and a charge transporting layer (CTL) 1*b*-4 in this order, with the undercoating layer 1*b*-1being disposed undermost.

Next, referring again to FIG. 1, laser light L corresponding to an image pattern in yellow irradiates the photosensitive drum 1 from an exposing apparatus 3 that is an electrostatic latent image forming means, thereby forming an electrostatic latent image on the photosensitive drum 1. Further, when the photosensitive drum 1 is rotated in the arrow direction, a developing apparatus 4*a* containing yellow toner is selected out of developing apparatuses 4*a*, 4*b*, 4*c*, and 4*d* that are each a developing means supported by a rotary supporting body 11 and respectively contain yellow toner, magenta toner, cyan toner, and black toner. The developing apparatus 4*a* is then rotated in the arrow direction so as to oppose the photosensitive drum 1, and the electrostatic latent image is visualized as a toner image by this developing apparatus 4*a*. When doing so, a development bias is applied from a development bias power supply 4A to a developing roller 4*a*1 of the developing apparatus 4*a*.

An intermediate transferring belt (intermediate transferring body) 5 functioning as the second image bearing body is rotated in the arrow direction at a speed that is substantially the same as the speed of the photosensitive drum 1. The toner image formed and bore on the photosensitive drum 1 is primarily transferred onto the outer peripheral surface of the intermediate transferring belt 5 by a primary transferring bias applied from a primary transferring bias power supply 8A to the primary transferring roller 8*a* that is a transferring means. The stated process is further performed for each of the magenta color, cyan color, and black color, so that toner images in a plurality of colors are formed on the intermediate transferring belt 5.

Next, transferring paper P that is a transferring material is fed from the inside of a transferring material cassette 12 by a pickup roller 13 at a predetermined timing. At the same time, a secondary transferring bias is applied from a secondary transferring bias power supply 8B to a secondary transferring roller 8*b*, thereby transferring the toner images from the intermediate transferring belt 5 to the transferring paper P.

Further, the transferring paper P is conveyed by a convey belt 14 to a fixing apparatus 6, at which the toner images are melted and fixed. In this manner, there is obtained a color image. Also, transferring residual toner on the intermediate transferring belt 5 is removed by an intermediate transferring belt cleaner 15, while the transferring residual toner on the photosensitive drum is removed by a cleaning apparatus 7 that is a well-known blade means.

Also, within the main body of the printer, a density sensor 9 that is a density detecting means is provided in the vicinity of the photosensitive drum 1.

In the case of a color image forming apparatus using an electrophotographic system, it becomes impossible to properly obtain the original color tone if image densities vary due to various conditions such as the number of printed sheets and variations of an environment in which the apparatus is used. In view of this problem, in a color printer or the like, with a method that is the same as the method described in the "Related Background Art" section of this specification, a toner image used to detect a density, which is to say a patch pattern, is experimentally formed on the photosensitive drum 1 using toner in each color, the density of each patch pattern is detected using the density sensor, and feedback control is performed using the detection results to adjust image forming conditions and the like, such as a development bias, the primary charge voltage, and the like. By performing image density control in this manner, there are obtained stabilized images.

Figure 3:
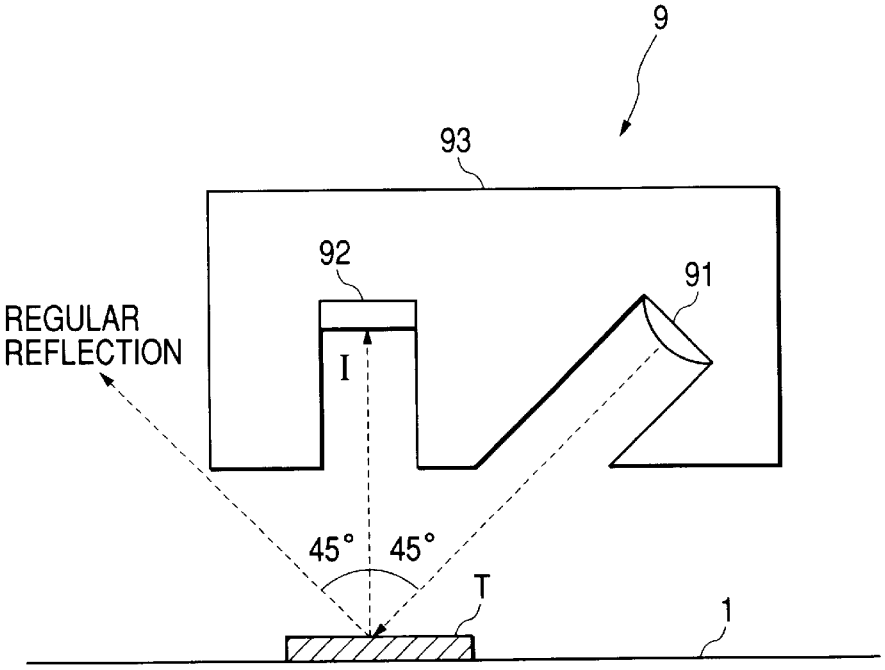
FIG. 3 is an explanatory diagram showing a density sensor of the color image forming apparatus shown in FIG. 1.

As shown in FIG. 3, the density sensor 9 includes a light-emitting element 91 such as an LED, a light-receiving element 92 such as a photodiode, and a holder 93. Infrared light from the light-emitting element 91 irradiates onto a patch pattern T on the photosensitive drum 1 and reflection light therefrom is measured by the light-receiving element 92. In this manner, the density of the patch pattern T is measured. The reflection light from the patch pattern T includes a regular reflection component and an irregular reflection component. The light quantity of the regular reflection component greatly varies in accordance with variations of the condition of the surface of the photosensitive drum 1 existing under the patch pattern T and a distance between the density sensor 9 and the patch pattern T. Therefore, if the regular reflection component from the patch pattern T is included and measured, the detection accuracy is significantly lowered. In view of this problem, this density sensor 9 measures only the irregular reflection light by setting an angle, at which the light irradiates the patch pattern T, at 45° and setting an angle, at which the reflection light from the patch pattern T is received, at 0° with reference to a normal line I.

It should be noted here that the patch pattern T is formed on the photosensitive drum 1 in a manner that is the same as that described in the "Related Background Art" section of this specification. That is, a computer (hereinafter also referred to as a "CPU") 20 inputs a patch pattern signal into a laser driver 21 and exposure on the photosensitive drum 1 is performed by a laser diode 22 through a polygon mirror 23 and the like. In this manner, there is formed the patch pattern T. Also, in the printer of this embodiment, during the patch formation, a state where the intermediate transferring belt 5 contacts the photosensitive drum 1 is reset and the intermediate transferring belt 5 is maintained so as not to contact the patch pattern T.

Each of the developing apparatuses 4*a* to 4*d* constitutes a developing cartridge that is independently detachably mountable to the rotary supporting body 11 and is provided with one of nonvolatile RAMs 30*a*, 30*b*, 30*c*, and 30*d* that are each a readable and writable storage means. In a like manner, the photosensitive drum 1, the primary charger 2, the cleaning apparatus 7, and a removed toner container 25 used to contain toner removed by the cleaning apparatus 7 integrally constitute a process cartridge A that is detachably mountable to the main body of the printer. This process cartridge also includes a nonvolatile RAM 32.

The developing cartridges 4*a* to 4*d* are each supported within the rotary body, so that it is impossible to establish connection between the RAMs 30*a* to 30*d* and the main body of the printer. Therefore, there are used memories of a radio frequency type. Consequently, it is required to read and write information from and into the memories via a read/write (R/W) means 31. Therefore, there is obtained a construction where when each of the developing cartridges 4*a* to 4*d* opposes the photosensitive drum 1 due to the rotation of the rotary supporting body 11, corresponding one of the RAM 30*a* to 30*d* and simultaneously comes close to and opposes the R/W means 31. In usual cases, the RAM 32 of the process cartridge A is connected to the main body via a connector (not shown in the drawing). However, a radio-frequency-type RAM that is the same as the RAMs used for the developing cartridges may be used instead.

Next, how the maximum image density is controlled in this embodiment will be described with reference to FIGS. 1 and 4 to 6.

The control of the maximum image density is performed when the CPU 20 detects an appropriate timing that relates to the power-on of the main body of the printer, an elapsed time since the power-on, the number of printed sheets, or the like.

Figure 4:
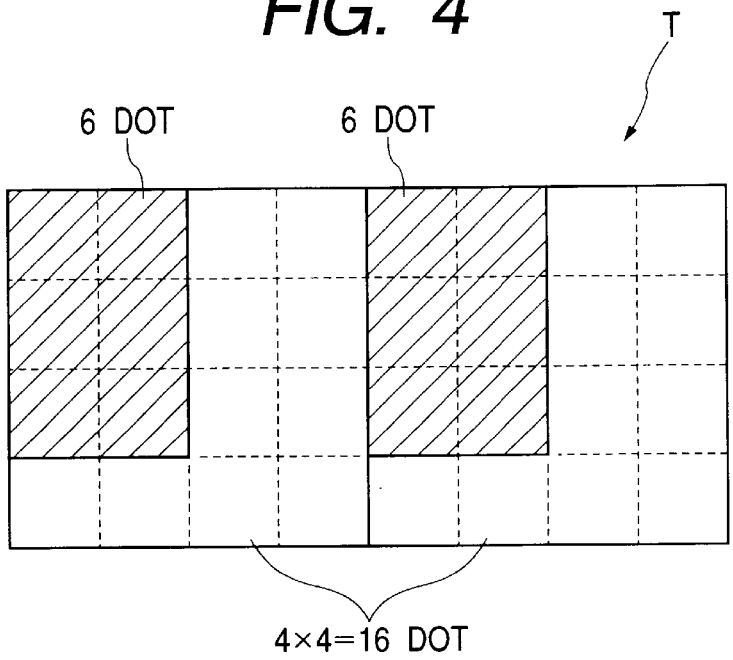
FIG. 4 shows an embodiment of a patch pattern.
Figure 5:
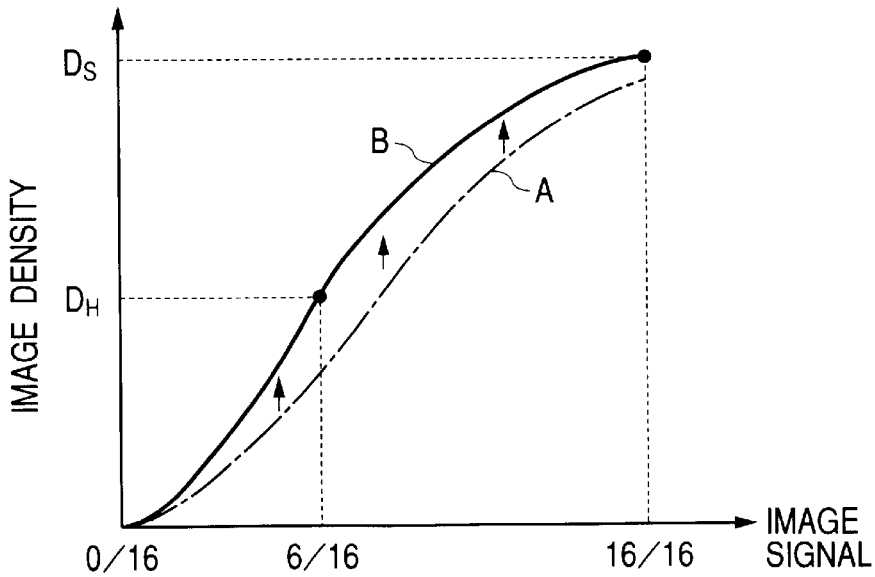
FIG. 5 shows how image densities are changed due to control of a development bias.

In this embodiment, the maximum image density is adjusted by changing the value of a developing bias voltage applied from the development bias power supply 4A to the developing cartridges 4*a* to 4*d*. In more detail, for instance, the patch pattern T shown in FIG. 4 is used. In this drawing, there is shown a 6/16 pattern in which 2×3 dots, out of 4×4 dots, are filled in. A dot-like halftone pattern is formed and a development bias is controlled so that the density of this pattern has a predetermined density value $D_H$ (in this embodiment, $D_H$ relates to a reflection density and is set at around 0.7). As a result of this control, as shown in FIG. 5, the density in a completely solid portion (the maximum density) is shifted from $D_S$ indicated by the alternate long and short dashed line A to $D_S$ indicated by the solid line B (in this embodiment, $D_S$ relates to the reflection density and is set at around 1.4).

Figure 6:
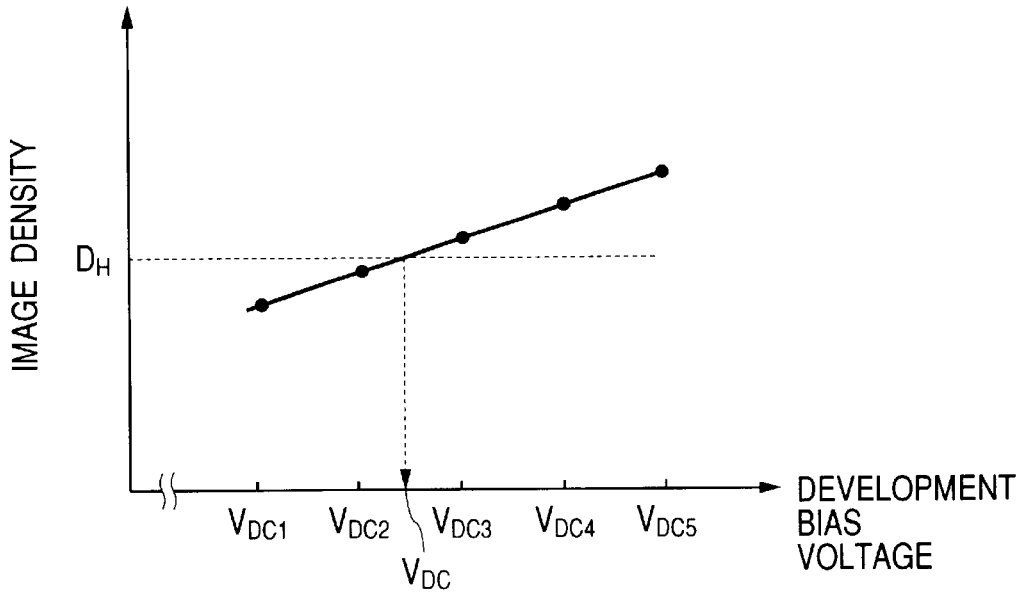
FIG. 6 is an explanatory diagram showing a method of determining a developing bias value with which there is obtained a patch pattern having a predetermined density value.

In order to determine a developing bias value $V_{DC}$ with which the 6/16 patch pattern actually takes the density value $D_H$, a plurality of developing bias values, such as $V_{DC1}$ to $V_{DC5}$, are used and a plurality of patch patterns T1 to T5 corresponding to the developing bias values are formed on the photosensitive drum 1, as shown in FIG. 6. The developing bias value $V_{DC}$ giving the density value $D_H$ is obtained by performing a calculation on results of measurement of the densities of these patch patterns by the density sensor 9.

Needless to say, patterns 16/16 containing 16 solid dots may be used as the patch patterns. However, variations of densities in accordance with variations of the developing bias value become mild in the vicinity of solid images and there occur significant control errors. Therefore, it is preferable that in actual cases, patch patterns of around 5/16 to 12/16 are used during the developing bias control.

It is possible to correct the maximum image density with the method described above. However, after endurance printing, that is, after long-term image formation is performed, the actual image density on the transferring paper is gradually shifted and lowered. The reason that this phenomenon occurs will be described with reference to FIGS. 7 to 9.

Figure 7:
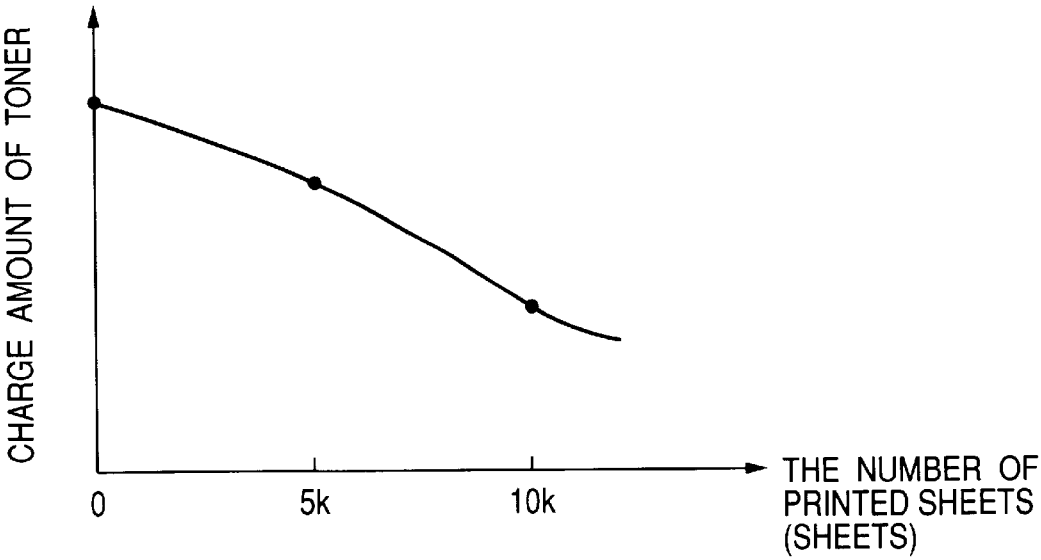
FIG. 7 is a graph showing how the charge amount of toner varies in accordance with the increase of the number of printed sheets.
Figure 8:
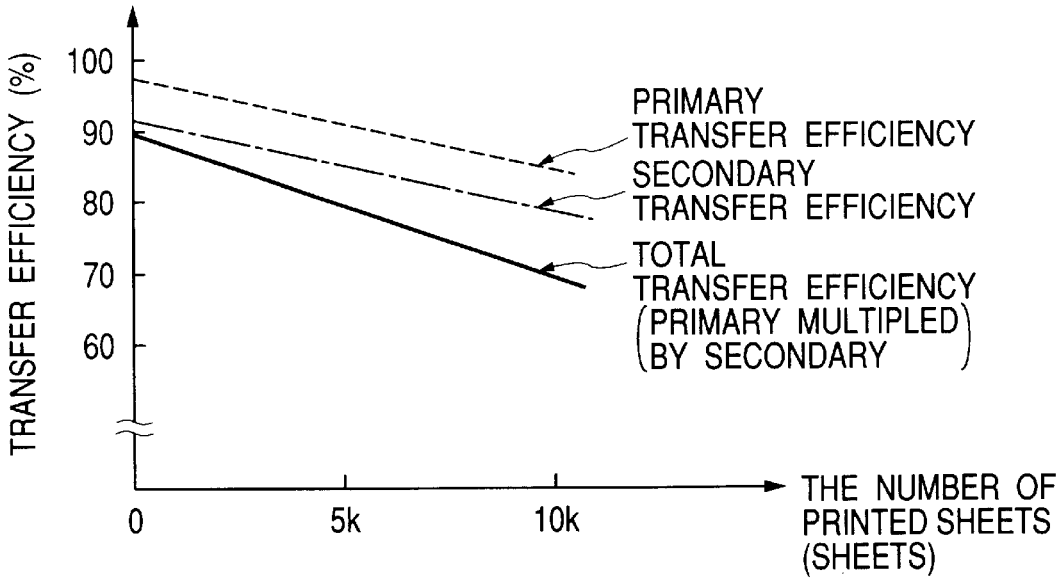
FIG. 8 is a graph showing how transfer efficiencies vary in accordance with the increase of the number of printed sheets.
Figure 9:
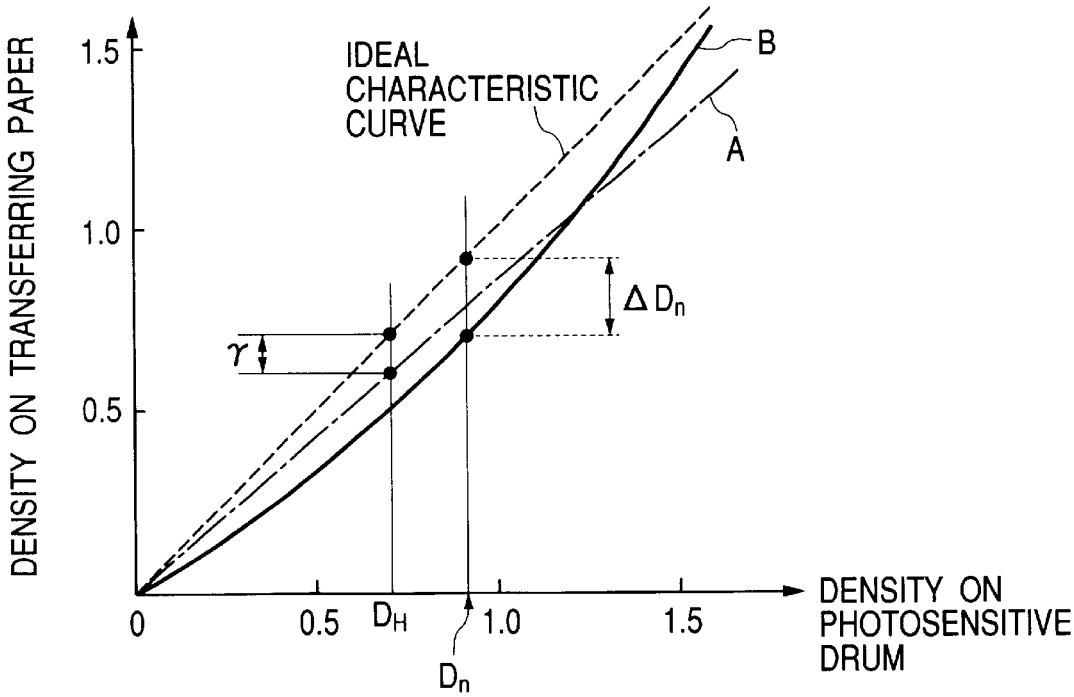
FIG. 9 is a graph showing deviations of image densities on transferring paper from image densities on a photosensitive drum.

FIG. 7 shows how the charge amount of toner varies due to endurance printing. As is apparent from FIG. 7, the toner charge amount is reduced in accordance with the increase of the number of printed sheets. FIG. 8 shows how the primary transfer efficiency, the secondary transfer efficiency, and the total transfer efficiency vary due to the reduction of the toner charge amount. The total transfer efficiency is obtained by multiplying the primary transfer efficiency by the secondary transfer efficiency. These transfer efficiencies are lowered in accordance with the increase of the number of printed sheets. Also, the primary transfer efficiency is the highest, the secondary transfer efficiency is the next highest, and the total transfer efficiency is the lowest. Further, FIG. 9 shows deviations of image densities on the transferring paper from image densities on a photosensitive drum due to variations of the transfer efficiencies. Note that which system is used affects the manner in which the image densities are shifted due to variations of the transfer efficiencies. Therefore, two typical cases A and B are shown in FIG. 9.

As is apparent from this drawing, even if the maximum density correction is performed, the image densities on the transferring paper are shifted and lowered after endurance printing. The shifts of the transfer efficiencies are mainly caused by variations of the charge characteristics of toner, so that the color and material of the toner, the variation in production lots of toner even of the same color, and the like affect the degree to which the transfer efficiencies are shifted.

In view of this problem, in this embodiment, a density shift amount, representing the degree to which an image density on the transferring paper will be shifted from the image density $D_H$ on the photosensitive drum is predicted for each developing cartridge. During the production of each developing cartridge, a correction parameter, which is to say a correction value $\alpha$, corresponding to this density shift amount is recorded in each of the nonvolatile RAMs 30*a* to 30*d* attached to the developing cartridges. It is possible to obtain the value of the correction value $\alpha$ by obtaining the magnitude of the developing bias voltage corresponding to the density shift amount using the relation shown in FIG. 6.

Further, a wearing degree $\beta$ of each developing cartridge corresponding to the total endurance number of printed sheets or the amount of consumed toner is sequentially written into corresponding one of the aforementioned RAMs 30*a* to 30*d*. Here, the wearing degree is defined as 0% when the process cartridge is not yet used. On the other hand, the wearing degree is defined as 100% when the process cartridge is at the end of its life cycle. A density shift amount $\Delta D$ representing the amount of the density shift due to the shifts of the transfer efficiencies is calculated using the aforementioned correction value $\alpha$ and this wearing degree $\beta$, and the developing bias value $V_{DC}$ used to perform image formation is corrected.

By way of example, it becomes possible to make a correction to the lowering of a density on the transferring paper due to the aforementioned endurance printing by obtaining a post-correction development bias $V_{DC}'$, which is a control parameter, from the pre-correction development bias $V_{DC}$ using the following expression.

$$V_{DC}'=V_{DC}+\alpha\cdot\beta/100$$

As one feature of the present invention, it is possible to properly make a correction for each developing cartridge even if the developing cartridge is detached and is mounted to another printer. This is because the correction value $\alpha$ and the wearing degree $\beta$ that are parameters for correcting the density shift amount $\Delta D$ are both recorded in the developing cartridge.

It should be noted here that as one method of obtaining the aforementioned wearing degree $\beta$ of each developing cartridge, it is possible to use a method that utilizes a well-known toner remaining amount detecting means for directly detecting the amount of toner remaining in each of the developing apparatuses 30*a* to 30*d* as an optical variation or a variation of electrostatic capacitance. In this case, the CPU 20 calculates the wearing degree $\beta$ from the detected toner remaining amount and uses the calculated wearing degree $\beta$. When doing so, it is possible to record the value of the wearing degree $\beta$ in each of the RAMs 30*a* to 30*d* of the developing cartridges.

Also, as another method of obtaining the wearing degree $\beta$ of each developing cartridge, the total number of dots recorded for print image signals may be obtained for each color (in the case of a halftone, counting is performed in units of one dot or less) and the toner consumption amount may be estimated. In this case, it is similarly possible for the CPU 20 to record the value of the wearing degree $\beta$ obtained from the estimated value in each of the RAMs 30*a* to 30*d* of the developing cartridges at an arbitrary timing and to read and use the value of the wearing degree $\beta$ as necessary.

Further, it is also possible to obtain the wearing degree $\beta$ with higher precision using both of the detection result by the aforementioned toner remaining amount detecting means and the estimation result concerning the toner consumption amount obtained from the total number of dots recorded for image signals which will be described below. The obtained wearing degree $\beta$ is recorded in each of the RAMs 30*a* to 30*d*.

Also, in this embodiment, during the endurance printing, the correction value $\alpha$ used to correct the variation of the density of the 6/16 patch pattern on the transferring paper due to variations of the transfer efficiencies is determined so as to correspond to a shift amount of the developing bias value. However, as one modification, a correction value $\gamma$ that directly corresponds to a density shift amount on the transferring paper may be determined (see FIG. 9). In this case, there may be used a method with which instead of correcting the developing bias value $V_{DC}$, a target value $D_H$ of the density of the 6/16 patch pattern on the photosensitive drum 1 is changed using the correction value $\gamma$ in accordance with the progress of an endurance printing operation. For instance, in the case where the density shift amount $\Delta D$, which represents the to which degree the density of the 6/16 patch pattern will be shifted due to transfer efficiency variations when the wearing degree $\beta$ is 100%, is 0.2, a new target value (target density) $D_H'$ that is a control parameter is obtained using the following expression by setting the correction value $\gamma$ at 0.2.

$$D_H'=D_H+\gamma\cdot\beta/100$$

By performing control so that the density of the 6/16 patch pattern on the photosensitive drum 1 takes this new target value, it becomes possible to perform control so that the 6/16 pattern density on the transferring paper takes a value that is almost the same as $D_H$ (=0.7).

As described above, with the technique of this embodiment, the amount $\Delta D$ of the density shift due to shifts of the transfer efficiencies is calculated for each developing cartridge using (1) the correction value $\alpha$ corresponding to the degree to which the density on the transferring paper will be shifted from the density $D_H$ on the photosensitive drum and (2) the wearing degree $\beta$ of each developing cartridge corresponding to the total endurance number of printed sheets or the amount of consumed toner. Then, the developing bias value $V_{DC}$ used to perform image formation is corrected. This makes it possible to economically perform image density control with stability at all time. In addition, this effect lasts for a long time.

Also, it is possible to obtain the same effect even if the target value $D_H$ concerning the patch pattern density on the photosensitive drum 1 is changed in place of correcting the developing bias value $V_{DC}$.

Second Embodiment

Next, the second embodiment of the present invention will be described mainly with reference to FIG. 10.

Figure 13:
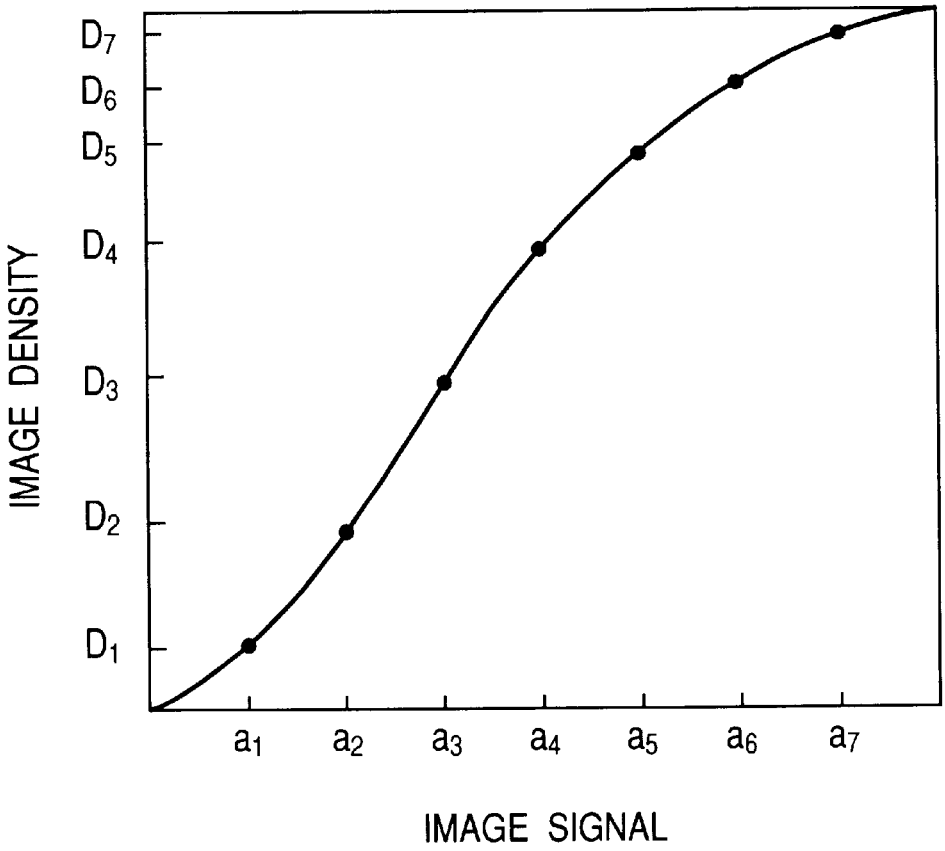
FIG. 13 shows a gradation characteristic of the electrophotographic image forming apparatus shown in FIG. 12.

In order to make a correction to a halftone image in the image forming apparatus shown in FIG. 1, it is required to use a look-up table (LUT) for correcting a gradation characteristic, such as the LUT that has been described with reference to FIG. 13 (see the "Related Background Art" section).

Also, the method described in the first embodiment is similarly applicable to halftone correction using the LUT as it is. A method of performing the halftone correction will be described with reference to FIG. 10.

Figure 10:
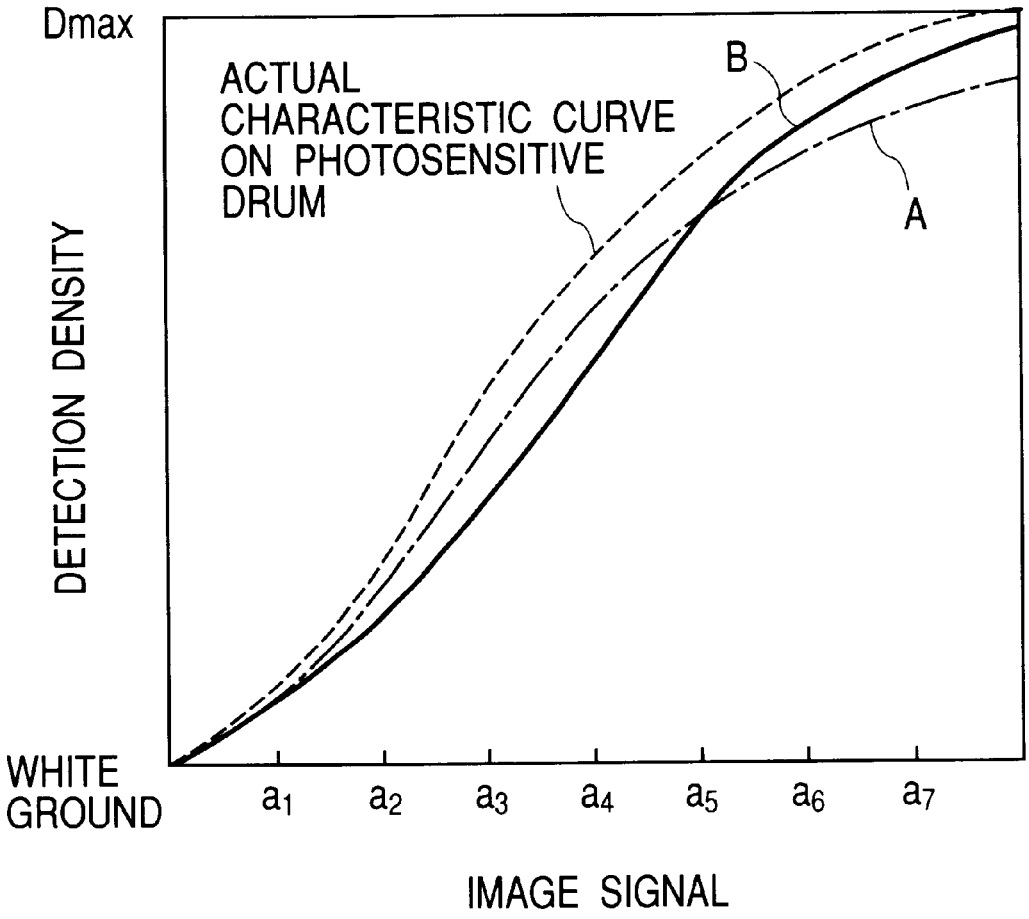
FIG. 10 shows relations between image signals corresponding to halftone patch patterns and image densities corresponding to these image signals.

In the graph shown in FIG. 10, the horizontal axis represents image signals $a_1$ to $a_7$ forming halftone patch patterns, while the vertical axis represents image densities $D_1$ to $D_7$ corresponding to these patch patterns.

In the modification of the first embodiment, there has been described a case where a patch pattern having a level equal to a 6/16 pattern is used on the assumption that the level of an image density signal for a white image is zero and the level of an image density signal for a solid image is one. Under this condition, the shift amount ΔD representing the degree to which the density of this pattern on the transferring paper will be shifted and lowered after endurance printing due to variations of the transfer efficiencies is set as the correction value γ, and the density control target value for the 6/16 pattern is changed to $D_H'$ according to the shift amount ΔD.

In this embodiment, in the manner shown in FIG. 10, a correction is made to a density conversion table with reference to reflection densities $D_1$ to $D_7$ of the patch patterns corresponding to the image signals $a_1$ to $a_7$ formed on the photosensitive drum 1. In more detail, as one example, in the case of the density shift indicated by the alternate long and short dashed line A shown in FIG. 9, a halftone density $D_n'$ on the transferring paper corresponding to a halftone density $D_n$ on the photosensitive drum 1 is obtained using the following expression by setting the solid image density on the photosensitive drum 1 as Dmax.

$$D_n' = D_n - \gamma(D_n/\mathrm{Dmax})\ (\beta/100)$$

The result of the correction made in this manner is shown by the alternate long and short dashed line A in FIG. 10. Note that the value of Dmax is generally set at around 1.4 to 1.6 on the basis of a reflection density. There occurs no problem even if Dmax is set at a fixed value such as 1.4, although it is preferable that a solid image patch is actually formed on the photosensitive drum, this solid image patch is measured, and the measurement result is used as the value of Dmax in order to further improve the accuracy.

Next, as another example, there will be described a case where the density shift characteristic has a curve shape like the solid line B in FIG. 9.

In this case, as the easiest method, there may be prepared a plurality of LUTs (tables giving shift amounts corresponding to density values on the photosensitive drum) that each give a deviation amount $\Delta D_n$ representing the degree to which the solid line B will deviate from the density $D_n$ on the ideal characteristic curve in FIG. 9. In this case, one arbitrary table is selected with reference to the value of a parameter γ (in the case where five tables have been prepared, for instance, the parameter γ is set at 1 to 5).

Then, a deviation amount $\Delta D_n$ corresponding to the density $D_n$ on the photosensitive drum is obtained by referring to the selected table and a correction that is the same as the correction described above is made using the following expression.

$$D_n' = D_n - \Delta D_n(\beta/100)$$

It should be noted here that needless to say, like in the first embodiment, a correction coefficient γ should be recorded in each of the RAMs 30*a* to 30*d* of the developing cartridges in advance.

With the technique of this embodiment, by creating LUTs using a relation (corresponding to the line A or B in FIG. 10) between image signals obtained after the correction performed in the manner described above and detection densities, it becomes possible to properly correct halftone densities on the transferring paper at all times throughout the endurance printing.

Third Embodiment

Next, the third embodiment of the present invention will be described with reference to FIG. 11.

Figure 11:
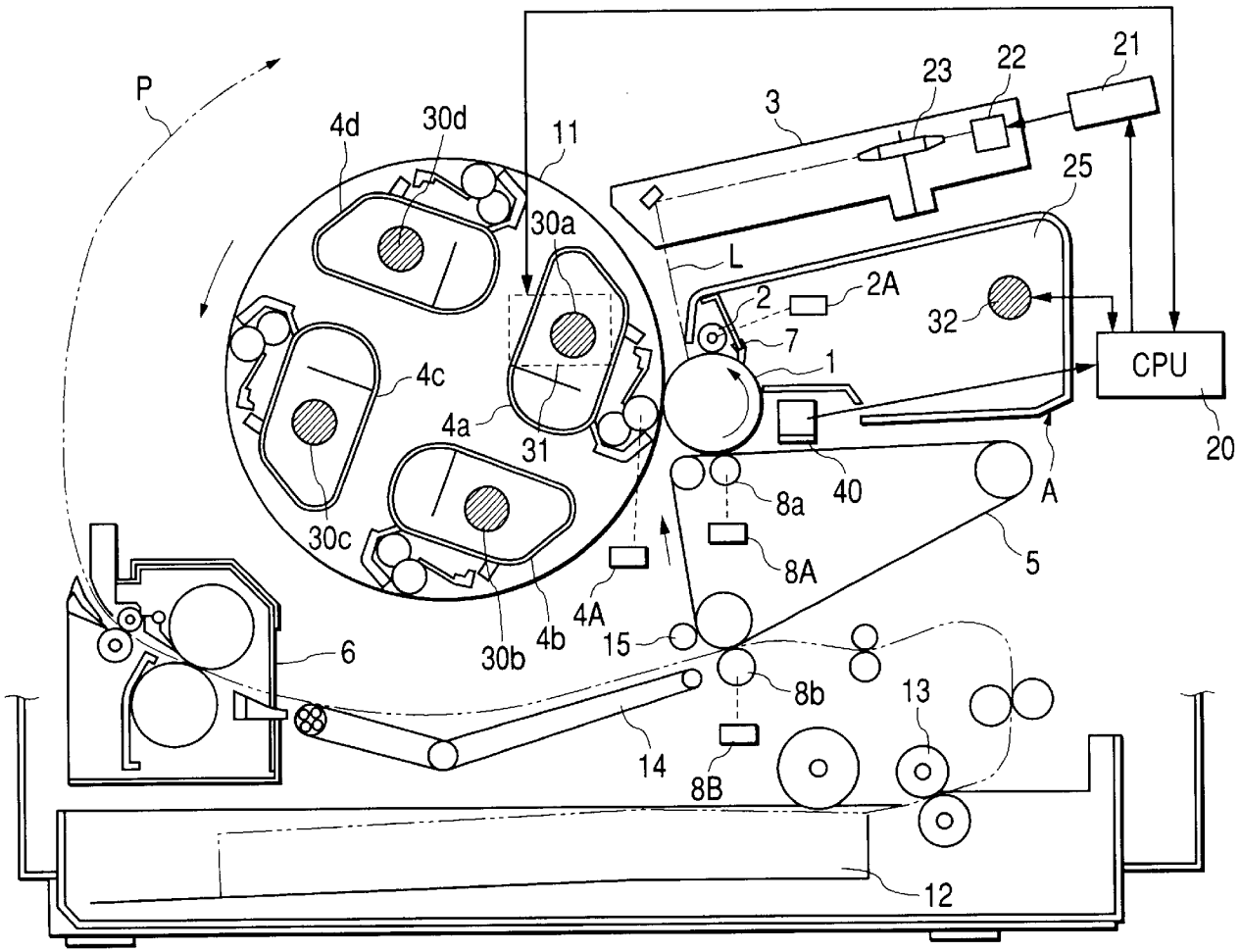
FIG. 11 is a construction diagram showing another embodiment of the color image forming apparatus according to the present invention.
Figure 12:
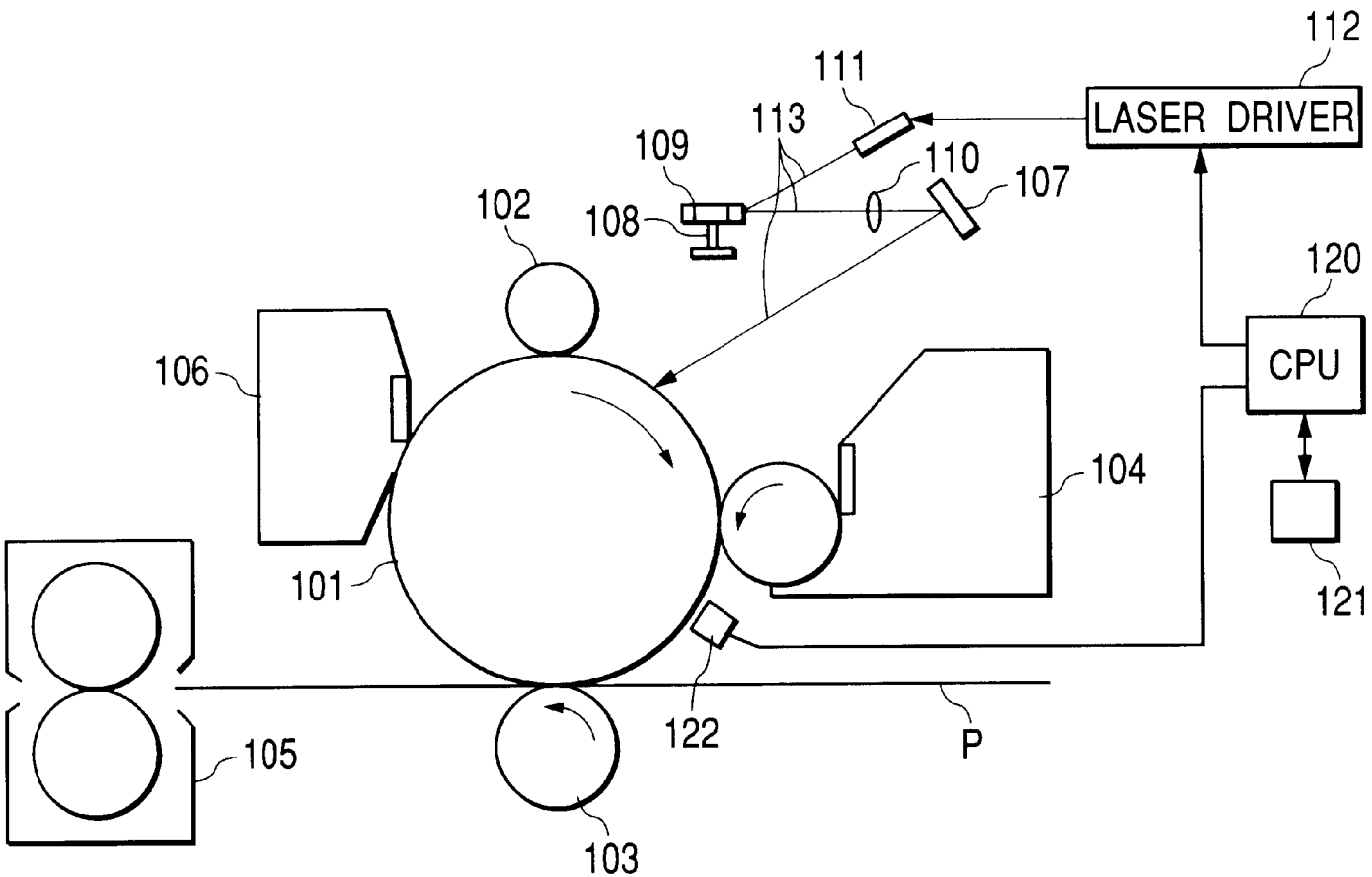
FIG. 12 is a construction diagram showing an example of a conventional electrophotographic image forming apparatus.

As shown in FIG. 11, an image forming apparatus of this embodiment has a construction that is almost the same as the construction described in the first embodiment. However, while patch patterns for the density detection are formed on the photosensitive drum 1 and the patch densities on the photosensitive drum 1 are directly measured using the density sensor 9 in the first embodiment, the densities of patch patterns obtained after the primary transfer from the photosensitive drum 1 onto the intermediate transferring belt 5 are detected using a density sensor 40 that is disposed so as to oppose the intermediate transferring belt 5 in this embodiment. Note that the density sensor 40 has a construction that is the same as the construction of the density sensor 9 described in the first embodiment.

With this construction, it becomes possible to eliminate factors responsible for the density variations due to the lowering of the primary transfer efficiency resulting from the endurance printing in FIG. 8. Even with this method, it is possible to carry out the present invention by setting correction parameters such as α, β, and γ in a manner that is completely the same as that described in the first or second embodiment.

Meanwhile, in the case where the detection of patch patterns is performed by measuring the densities thereof using the density sensor 40 after the primary transfer as described above, it becomes possible to adopt a correction method that is different from those described in the first and second embodiments. That is, only during the patch pattern detection, the primary transferring bias value for transferring the patch patterns onto the intermediate transferring belt 5 is changed so as to lower the transfer efficiency for the patch patterns. In this manner, it becomes possible to allow the patch patterns obtained after the primary transfer to have densities that are virtually equal to the densities of images obtained after the secondary transfer during normal printing.

In this case, there may be used a method with which transfer performance is lowered by intentionally decreasing the transferring bias for the patch patterns. Alternatively, there may be used a method with which the densities of patch patterns on the intermediate transferring belt 5 are lowered by intentionally increasing the transferring bias and transferring the patch patterns onto the photosensitive drum 1 again. In either case, it is possible to correct the transferring bias voltage with a method that is the same as the method of correcting the developing bias voltage described in the first embodiment. Therefore, there is omitted the detailed description of the method of correcting the transferring bias voltage.

It should be noted here that in this embodiment, there has been described a method of correcting the developing bias voltage or the transferring bias voltage in order to perform image control. However, it is also possible to make this correction by controlling the primary charge bias voltage. Consequently, the charging means including the charge bias power supply, the developing means including the development bias power supply, the transferring means including the transferring bias power supply, and the like may be referred to as the image control means.

The present invention has been described above based on the first to third embodiments, although the present invention is not limited to the constructions used in the embodiments. For instance, in addition to the image forming system using an intermediate transferring body, the present invention is similarly effective even in the case of a multiplex transfer system where transferring paper is wound around a transferring drum and direct transfer from the same photosensitive drum is performed two or more times, a tandem system with which transfer onto transferring paper is performed by one operation using a plurality of photosensitive bodies and developing devices, or another image forming system.

It should be noted here that in the third embodiment, there has been described the case where the densities of patch patterns on the intermediate transferring belt are detected. However, in the case of the tandem system described above, there may be a case where the density detection is performed by forming patch patterns on a convey belt that is usually used to convey transferring paper under suction. Even in such a case, it is possible to similarly carry out the third embodiment as well as the first and second embodiments as they are.

While the above described embodiments represent the preferred form of the present invention, it is to be understood that modifications will occur to those skilled in that art without departing from the spirit of the invention. The scope of the invention is therefore to be determined solely by the appended claims.

What is claimed is:

1. An image forming apparatus in which a cartridge is detachably attachable, the cartridge having at least a toner containing part and a memory in which predetermined information is stored, comprising:

an image bearing member;

an image forming part for forming a toner image on said image bearing member;

a detector for detecting the density of the toner image on said image bearing member;

a transferring part for transferring an image to be recorded onto a transferring material on said image bearing member directly or indirectly to the transferring material;

a density adjusting control part for forming a predetermined pattern on said image bearing member, executing a detection of the density of the predetermined pattern with said detector, and determining an image forming condition according to a result of the detection of the density of the predetermined pattern; and an image recording control part for forming an image to be recorded onto the transferring material under the image forming condition determined by said density adjusting control part, wherein, in the case that the image is to be recorded onto the transferring material, the density adjusting control part determines the image forming condition such that an image density on said image bearing member is varied depending on the predetermined information stored in the memory of the cartridge.

2. An image forming apparatus according to claim 1, wherein the predetermined information is information of at least a value relating to the color, the material, or the lot number of toner contained in the toner containing part.

3. An image forming apparatus according to claim 1, wherein the predetermined information is information relating to the change in charge characteristics with time of toner contained in the toner containing part.

4. An image forming apparatus according to claim 1, wherein said density adjusting control part forms the predetermined pattern on said image bearing member by using a plurality of developing biases, and determines a developing bias corresponding to a target density varying according to the predetermined information stored in the memory of the cartridge as the developing bias in the case that the image to be recorded is formed onto the transferring material.

5. An image apparatus according to claim 1, wherein said image forming part forms a toner image onto another image bearing member different from said image bearing member and transfers the image from said another image bearing member onto said image bearing member.

6. An image forming apparatus according to claim 5, wherein said density adjusting control part forms the predetermined pattern on said another bearing member by using a plurality of developing biases, transfers the predetermined pattern onto said image bearing member from said another image bearing member under a transferring condition according to predetermined information stored in the memory of the cartridge, and determines a developing bias corresponding to a target density as the developing bias in the case that the image to be recorded is formed onto the transferring material, based on the relationship between the developing bias and the detected density.

7. An image forming apparatus according to claim 1, wherein said density adjusting control part uses a density conversion table for converting density information from an output of said detector so as to detect the density of the image on said image bearing member, forms the predetermined pattern onto said image bearing member under a plurality of image forming conditions, detects the density of the predetermined pattern by using a density conversion table different according to the predetermined information stored in the memory of the cartridge, and determines the image forming condition corresponding to a target density based on the relationship between the image forming condition and the detected density as the image forming condition in the case that the image to be recorded is formed onto the transferring material.

8. An image forming apparatus according to claim 1, wherein said apparatus includes a look-up table for correcting gradation characteristics of an image signal, and wherein said density adjusting control part predetermines a different look-up table according to the predetermined information stored in the memory of the cartridge as the image forming condition for forming the image to be recorded onto the transferring material.

9. An image forming apparatus according to claim 1, wherein the cartridge further comprises developing means.

10. An image forming apparatus according to claim 1, wherein the cartridge is a process cartridge integrally including an electrophotographic photosensitive member as said image bearing member, and at least one of charging means for charging said electrophotographic photosensitive member and cleaning means for cleaning the electrophotographic photosensitive member.

11. A cartridge detachably attachable to an image forming apparatus which includes a transferring part for transferring a toner image on an image bearing member directly, or indirectly to a transferring material, and a density adjusting control part for forming a predetermined pattern on the image bearing member, detecting the density of the predetermined pattern and determining an image forming condition according to the result of the detection of the density of the predetermined pattern, comprising:

a toner containing part; and a memory for storing predetermined information, and wherein in the case that an image is to be recorded onto the transferring material, the density adjusting control part determines the image forming condition such that the image density on said image bearing member is varied depending on the predetermined information stored in the memory of the cartridge.

12. A cartridge according to claim 11, wherein the predetermined information is information of at least a value relating to the color, the material or the lot number of toner contained in the toner containing part.

13. A cartridge according to claim 11, wherein the predetermined information is information relating to the change in charge characteristics with time of toner contained in the toner containing part.

14. A cartridge according to claim 11, wherein the density adjusting control part forms the predetermined pattern onto the image bearing member using a plurality of developing biases and determines a developing bias corresponding to a target density based on the relationship between the developing bias and the detected density, and wherein the predetermined information stored in said memory is information which is used for determining the target density by the density adjusting control part.

15. A cartridge according to claim 11, further comprising developing means.

16. A cartridge according to claim 11, wherein said cartridge is a process cartridge integrally including an electrophotographic photosensitive member as the image bearing member, and at least one of charging means for charging the electrophotographic photosensitive member and cleaning means for cleaning the electrophotographic photosensitive member.

17. A memory included in a cartridge which has at least a toner containing part and is detachably attachable to an image forming apparatus including a transferring part for transferring a toner image on an image bearing member directly or indirectly to a transferring material, and a density adjusting control part for forming a predetermined pattern on the image bearing member, detecting the density of the predetermined pattern, and determining an image forming condition according to the result of the detection of the density of the predetermined pattern, wherein said memory stores predetermined information, and wherein, in the case that the image is to be recorded on the transferring material, the density adjusting control part determines the image forming condition such that the image density on said image bearing member is varied depending on the predetermined information stored in the memory of the cartridge.

18. A memory according to claim 17, wherein the predetermined information is information of at least a value relating to the color, the material or the lot number of a toner contained in the toner containing part.

19. A memory according to claim 17, wherein the predetermined information is information relating to the change in charge characteristics with time of toner contained in the toner containing part.

20. A memory according to claim 17, wherein the density adjusting control part forms the predetermined pattern onto the image bearing member by using a plurality of developing biases and determines a developing bias corresponding to a target density based on the relationship between the developing bias and the detected density, and wherein the predetermined information stored in said memory is information which is used for determining the target density by the density adjusting control part.

* * * * *

UNITED STATES PATENT AND TRADEMARK OFFICE

CERTIFICATE OF CORRECTION

PATENT NO. : 6,799,001 B2
DATED : September 28, 2004
INVENTOR(S) : Akihiko Takeuchi et al.

It is certified that error appears in the above-identified patent and that said Letters Patent is hereby corrected as shown below:

Column 2,
Line 46, “the are” should read -- are --.

Column 3,
Line 61, close up right margin.
Line 62, close up left margin.

Column 5,
Line 12, “cross sectional” should read -- cross-sectional --.

Column 6,
Line 7, “an” should read -- a --.
Line 10, “1b-1being” should read -- 1b-1 being --.

Column 13,
Line 21, “above described” should read -- above-described --.

Column 16,
Line 18, “a” should be deleted.

Signed and Sealed this

Fourth Day of January, 2005

JON W. DUDAS
*Director of the United States Patent and Trademark Office*